US007134806B2

(12) United States Patent
Lazic

(10) Patent No.: US 7,134,806 B2
(45) Date of Patent: Nov. 14, 2006

(54) REPAIRING ROAD SURFACES

(75) Inventor: Zvjezdan Lazic, Saskatoon (CA)

(73) Assignee: Her Majesty the Queen in right of the Province of Saskatchewan, as represented by the Minister of Highways and Transportation, Regina (CA)

( * ) Notice: Subject to any disclaimer, the term of this patent is extended or adjusted under 35 U.S.C. 154(b) by 59 days.

(21) Appl. No.: 10/973,311

(22) Filed: Oct. 26, 2004

(65) Prior Publication Data

US 2006/0088379 A1 Apr. 27, 2006

(51) Int. Cl.
*E01C 19/21* (2006.01)

(52) U.S. Cl. ..... 404/111; 404/101; 404/108

(58) Field of Classification Search ..... 404/101, 404/108, 111

See application file for complete search history.

(56) References Cited

U.S. PATENT DOCUMENTS 3,945,619 A * 3/1976 Taibi ..... 366/18
4,406,548 A * 9/1983 Haws ..... 366/8
4,457,660 A * 7/1984 Pippinger ..... 414/332
4,995,909 A * 2/1991 Schilling ..... 106/277
5,190,400 A * 3/1993 Sterner ..... 404/103
5,240,324 A * 8/1993 Phillips et al. ..... 366/132
5,401,115 A * 3/1995 Musil et al. ..... 404/72
5,590,976 A * 1/1997 Kilheffer et al. ..... 404/72
5,791,814 A * 8/1998 Wiley ..... 404/91
6,375,386 B1 * 4/2002 Macku et al. ..... 404/17
6,706,108 B1 * 3/2004 Polston ..... 106/285
2004/0168611 A1 * 9/2004 Dresin et al. ..... 106/273.1

* cited by examiner

*Primary Examiner*—Raymond W Addie
(74) *Attorney, Agent, or Firm*—Law Offices of Albert Wai-Kit Chan, LLC

(57) ABSTRACT

A method of repairing a road surface includes providing a hopper mounted on a spreading vehicle and means to spread material carried in the hopper over depressed areas of the road surface to fill them with the material. At ambient temperature, a batch of patching slurry is mixed comprising aggregate, asphalt emulsion, water, Portland cement, and a retarding agent operative to increase a break time of the patching slurry, and the batch is deposited into the hopper. The spreading vehicle is maneuvered to spread the patching slurry successively over a plurality of depressed areas until the hopper is empty. The ingredients of the patching slurry are adjusted to provide a patching slurry having a break time sufficiently long to allow the hopper to be emptied before the patching slurry begins to set, and sufficiently short to allow traffic to pass over a filled depressed area within a desired time.

15 Claims, 2 Drawing Sheets

REPAIRING ROAD SURFACES

This invention is in the field of road maintenance and in particular repairing depressed areas, such as localized ruts and depressed cracks, in road surfaces.

BACKGROUND

Road surfaces are subject to varied faults that develop due to traffic and weather. For example asphalt road surfaces can develop relatively narrow depressions or ruts in the direction of traffic flow caused by heavy trucks and the like. These ruts can be relatively short and localized, or often can continue for a considerable distance, often for miles, along the road.

Asphalt road surfaces are typically laid with two passes of a paving machine that abut each other at the centerline of the road. Cracks commonly develop along the centerline where the two passes meet. Again thermal expansion and contraction due to weather extremes can cause lateral cracks that extend from the centerline to the edge of the road. A characteristic of these cracks is that the edges are depressed causing increased impact forces on the edges from traffic, and leading to further deterioration of the road surface.

At typical ambient temperatures, most asphalts are highly viscous and too stiff to apply to a roadway. To get it into a form that can be applied requires the viscosity to be reduced. This can be done by heating the asphalt, by diluting the asphalt with gasoline, kerosene or the like to make a cutback asphalt, or by making an asphalt emulsion.

Cutback asphalts harden when the diluting fluid evaporates into the atmosphere. Environmental concerns have thus made the use of such diluted asphalt undesirable. Asphalt emulsions consist of water with fine particles of asphalt dispersed in it, and thus do not present a similar environmental risk. Chemical solutions called emulsifiers give the asphalt particles the ability to stay suspended in water, and such asphalt emulsions are well known and are formulated to have a desired viscosity suitable for applications at ambient temperature. Polymers are commonly added to the asphalt emulsion to increase cohesion of the asphalt to aggregate.

Conventional road surface maintenance procedures include using slurries in various applications. A slurry is a mixture of fine aggregate, asphalt emulsion, and fillers that is cold mixed at ambient temperature. The asphalt emulsion serves as a binder, holding the particles of the aggregate together and binding the slurry to the surface on which it is applied. The fillers are added to stabilize or modify the characteristics of the slurry. Once all the ingredients are mixed together, a break time begins to count down. The slurry "breaks" when the asphalt separates from the water in the asphalt emulsion, either by evaporation or with the aid of emulsifiers that react with the aggregate. Adding Portland cement as a filler also reduces the break time, and further gives the slurry a creamy consistency that aids in even spreading. After the slurry breaks, it cures or hardens to a satisfactory hardness to support traffic.

When slurries are first mixed, they are in liquid form of varying viscosities according to the ingredients and thus readily flow into cracks and depressions and leave a smooth surface. As time passes the slurry breaks and then cures. The slurry must therefore be placed in position on the road surface within that period of time after mixing where it is liquid and prior to breaking. Water and other materials are added to the slurry to provide the desired viscosity and break time.

Slurries are commonly used to spread in a relatively thin layer across the surface of a road to seal the road, and restore a skid resistant surface. Considerable care must be taken with the aggregate used in a slurry. The aggregate particles must be sourced from crushed rock in order to provide particles with jagged edges so that they bind to the asphalt emulsion in a satisfactory manner. Fine particles from a pit or like natural source typically have relatively smooth surfaces that have been polished by wind and water over considerable time, and thus are not generally satisfactory for use in a slurry.

Such sealing slurries are commonly mixed in batches and the ingredients chosen to provide a long break time, an hour or more, so that the operators will have time to spread the slurry on the area, or a number of different areas, where it is required. The long break time somewhat delays the resumption of traffic flow on the road, however sealing a whole lane surface is an operation that is not required on a regular basis and so the delay in traffic resumption is considered acceptable.

Slurries have also been developed that are suitable for filling long and relatively deep ruts in road surfaces, as well as re-surfacing whole road surfaces, using a process commonly referred to as microsurfacing. Microsurfacing slurries have a very short break time, typically minutes, so that the thicker layer of slurry will harden quickly and traffic delays will be minimized. In order to mix and apply microsurfacing slurries, a mobile vehicle with a continuous mixing apparatus is used that carries the ingredients and mixes and applies the slurry as the apparatus moves along the rut. The apparatus is also configured to load aggregate and other ingredients from transport vehicles as it moves along the road so that the slurry can be laid down in long continuous stretches to maintain a smooth, uninterrupted surface.

The International Slurry Surfacing Association provides two guideline publications on their web-site at www.slurry-.org entitled Recommended Performance Guidelines for Emulsified Asphalt Slurry Seal Surfaces 2003, and Recommended Performance Guidelines for Polymer Modified Micro-Surfacing 2003.

Localized depressed areas such as lateral depressed cracks and localized ruts are typically present at fairly widely spaced intervals along a road. For repairing localized depressed areas, cold mixed slurries have not been used. In repairing such cracks it is desired to use a material that remains liquid for a time long enough for the crew to move from one crack to the next some distance down the road. Each of a plurality of depressed lateral cracks requires a relatively small amount of material to fill it, and so a hopper and spreader box mounted on a loader vehicle can generally hold enough material to fill several cracks. Once laid it is desired to have the material set or harden very quickly so that traffic flow can be resumed. Thus it is preferred to use a hot mix sulfur asphalt material. This hot mix is mixed with a heated mixer, and then typically placed in a heated hopper on a loader vehicle and carried to the cracks and applied as the repair material. When maintained at a high temperature in the heated loader hopper, the hot mix stays liquid and flows readily. When applied to the road surface in a relatively thin layer, the material rapidly cools and hardens so that it is ready for traffic almost immediately after it is laid. Such hot mixes are also commonly used to patch depressed centerline cracks, as well as localized depressed areas.

Application of the repair material to the road typically uses essentially the same process for sealing slurry, microsurfacing slurry, and hot mix. The material flows into a spreading box that lays the material on the road surface as the spreading box is moved forward. The spreading box maintains close contact with the road surface on each side of the rut or crack and provides a straight edge along the back from one side to the other to screed or level the material as the box moves forward. In a continuous process like microsurfacing, the spreader box is dragged along behind the mixing vehicle and fed directly from the mixer. When applying a sealing slurry the spreader box is generally the same width as a road lane and the box is dragged behind a vehicle carrying a batch of sealing slurry. In a hot mix batch process, the spreader box is typically mounted to the underside of a heated hopper or bucket mounted on a loader vehicle. The batch of hot mix is placed in the hopper where an agitator maintains the uniformity of the mix, and flow to the spreader box underneath is controlled with a gate. The operator moves from crack to crack, dragging the hopper and box along the crack and controlling the amount of material released into the box so that the box is substantially empty when it reaches the end of the crack, and the hot mix is feathered out to the end of the crack at the edge of the road.

The conventional hot mixes used to patch localized depressed areas comprise asphalt oil, sand, and sulfur. The asphalt oil is typically heated to about 325° C. and the sand is heated to about 350° C. Conveniently natural sand, suitably washed or screened, can be used instead of crushed sand since the asphalt oil adheres better when heated rather than being carried in an emulsion. Sulfur is added in order to hasten hardening. Without sulfur, it could take 20 minutes or more for the mix to cool and harden, while with added sulfur hardening is very quick, so that traffic may be resumed almost immediately in many cases. Where the depressed areas are deeper however, it is generally desirable to delay traffic somewhat to allow the thicker mix to harden prior to traffic resumption.

The presence of sulfur in the hot mix causes the mix to give off malodorous fumes, and health concerns arise concerning workers exposed to sulfur fumes. There are as well environmental concerns respecting the use of sulfur on roads where it can be washed into surrounding soil by rain. As well heating the mixer and hopper requires combustion of fuels like propane which are inherently hazardous. Equipment and fuel for heating the hot mix also adds considerably to the cost of patching lateral depressed cracks.

SUMMARY OF THE INVENTION

It is an object of the present invention to provide a method and apparatus for repairing localized depressed areas in road surfaces that overcome problems in the prior art.

The present invention provides, in a first embodiment, a method of repairing a road surface by filling depressed areas of the road surface with a patching slurry. The method comprises providing a hopper mounted on a spreading vehicle and an agitator in the hopper to agitate the contents of the hopper, and providing means mounted on the spreading vehicle to spread material carried in the hopper over and along a depressed area to fill the depressed area with the material; at substantially ambient temperature, mixing a batch of patching slurry comprising ingredients including aggregate, asphalt emulsion, water, Portland cement, and a retarding agent operative to increase a break time of the patching slurry, and depositing the batch of patching slurry into the hopper; successively maneuvering the spreading vehicle to spread the patching slurry carried in the hopper over a plurality of depressed areas until the hopper is empty. The ingredients of the patching slurry are adjusted to provide a patching slurry having a break time sufficiently long to allow the hopper to be emptied before the patching slurry begins to set, and sufficiently short to allow traffic to pass over a filled depressed area within a desired time.

The present invention provides, in a second embodiment, an apparatus adapted for mounting on a mixing vehicle for mixing a patching slurry for repairing a road surface by filling depressed areas of the road surface with the patching slurry. The apparatus comprises a mixing bowl; an aggregate holding tank, and an aggregate measuring tank operatively connected to the aggregate holding tank to receive aggregate therefrom, and means operative to transfer the contents of the aggregate measuring tank into the mixing bowl; an asphalt emulsion holding tank, and an asphalt emulsion measuring tank operatively connected to the asphalt emulsion holding tank to receive asphalt emulsion therefrom, and means operative to transfer the contents of the asphalt emulsion measuring tank into the mixing bowl; a water holding tank, and a water measuring tank operatively connected to the water holding tank to receive water therefrom, and means operative to transfer the contents of the water measuring tank into the mixing bowl; means to add a measured amount of Portland cement to the mixing bowl; means to add a measured amount of a retarding agent to the mixing bowl, the retarding agent operative to increase a break time of the patching slurry; a mixer operative to mix aggregate, Portland cement, asphalt emulsion, water, and retarding agent contained in the mixing bowl into a patching slurry having a temperature substantially equal to ambient temperature; and means to transfer the patching slurry out of the mixing bowl into a spreading vehicle.

Conventional road repair slurries using asphalt emulsion at ambient temperatures follow either a slow-set, slow-traffic curing curve, as in sealing slurries, or a quick-set, quick-traffic curing curve, as in microsurfacing slurries. Neither of these curing curves is conducive to repairing localized depressed areas such as depressed lateral cracks and localized rutting by filling them with slurry from a spreading box carried by a vehicle. On one hand, the quick-set, quick traffic microsurfacing slurry does not allow for the spreading vehicle to travel from one depressed area to the next before breaking. On the other hand, the slow-set, slow traffic sealing slurry does not allow resumption of traffic within a satisfactory time in a patching application where a considerable length of road could need to be blocked to traffic during a routine patching operation.

For that reason hot mix sulfur asphalt has been conventionally utilized for this purpose. The hot mix is maintained at a high temperature while being carried from one depressed road surface area to the next and so is prevented from setting, and once applied to the road surface, it quickly cools and with the additional sulfur it is ready for traffic almost immediately. The hot mix sulfur asphalt material thus follows a slow-set, quick-traffic curing curve that is ideal for patching localized depressed areas.

By adjusting the ingredients of an asphalt emulsion slurry, the present invention provides a patching slurry that has a slow-set, quick-traffic curing curve similar to that of the hot mix sulfur asphalt material. Using such a modified patching slurry, breaking of the slurry can be delayed so that a conventional spreader box vehicle, such as that used with hot mix sulfur asphalt, can apply a hopper full of patching slurry to a plurality of areas along a significant stretch of road before the patching slurry breaks, while at the same time, once the patching slurry breaks, it hardens quickly so that traffic can resume.

The use of such a modified patching slurry requires that the slurry be mixed in small batches, just enough to fill the hopper of the spreading vehicle. Once the asphalt emulsion is added to the other ingredients, the break period is initiated, and so the batch must be spread within the limited break time. Typically the modified patching slurry will be formulated to have a break time of about 20 minutes, which is sufficient to allow a typical hopper of patching slurry to be placed in depressed areas along a substantial length of road. The invention therefore provides an apparatus for conveniently measuring the required ingredients, mixing them into the patching slurry, and transferring the patching slurry into the hopper.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
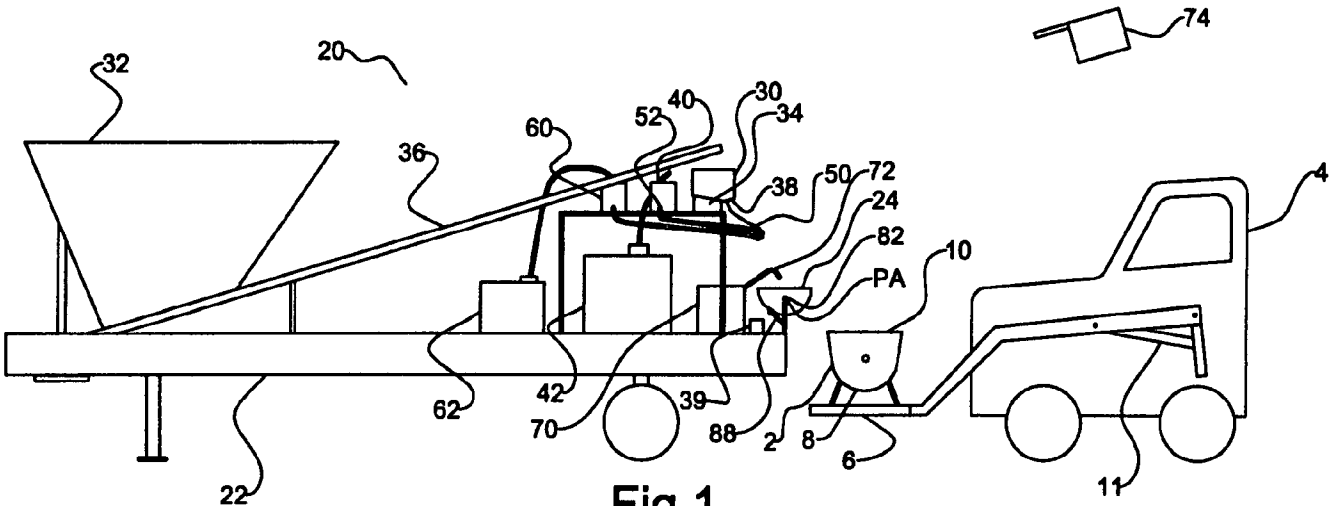
FIG. 1 is a schematic side view of a mixing vehicle of the invention and a suitable spreading vehicle.
Figure 2:
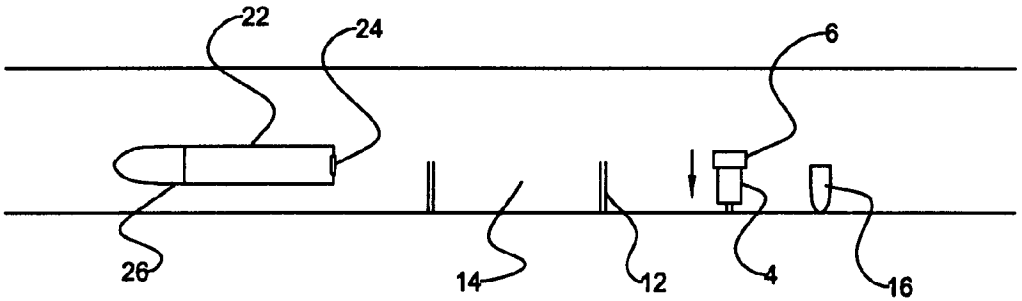
FIG. 2 is a schematic top view of a patching operation using the mixing and spreading vehicles of FIG. 1.

As schematically illustrated in FIGS. 1 and 2, the present method of repairing a road surface by filling depressed areas of the road surface with a patching slurry comprises providing a hopper 2 mounted on a spreading vehicle 4, and providing means mounted on the spreading vehicle 4 to spread material carried in the hopper 2 over and along a depressed area to fill the depressed area with the material. Typically a spreader box 6 is mounted on the vehicle 4 under the hopper 2, and a gate 8 selectively releases material carried in the hopper 2 into the spreader box 6. An agitator 10 in the hopper 2 agitates the contents of the hopper 2. An actuator 11 moves the spreader box 6 and hopper 2 up and down with respect to the vehicle 4.

No heat is used in the method of the invention and all operations take place at ambient temperatures typically between 10° C. and 30° C. A batch of patching slurry of a volume to fit into the hopper 2 is mixed and deposited into the hopper 2. The patching slurry comprises aggregate, asphalt emulsion, water, Portland cement, and a retarding agent operative to increase a break time of the patching slurry.

The spreading vehicle 4 is maneuvered in a conventional manner, as illustrated in FIG. 2, to spread the patching slurry carried in the hopper 2 over a plurality of depressed areas, such as the depressed lateral cracks 12 in the road surface 14, until the hopper 2 is empty. The operator typically drops the box 6 at the centerline end of the crack 12 and opens the gate 8 to allow patching slurry to flow into the box 6. The spreader vehicle drags the box 6 along the crack, and the operator controls the gate 8 so that the box 6 is empty at the outside end of the crack 12 at the edge of the road. The laid patching slurry 16 is spread thinly over the width of the spreader box 6, and narrows somewhat as the box 6 empties at the edge of the road.

The ingredients of the patching slurry are adjusted to provide a slurry having a break time sufficiently long to allow the hopper 2 to be emptied before the slurry begins to set, and sufficiently short to allow traffic to pass over a filled depressed area within a desired time. Typically the break time is between 10 and 30 minutes, and between 15 and 25 minutes, or about 20 minutes will generally be the time required to ensure the operator has time to empty the hopper before the patching slurry begins to break.

The International Slurry Surfacing Association provides guideline publications on their web-site at www.slurry.org entitled Recommended Performance Guidelines for Emulsified Asphalt Slurry Seal Surfaces 2003, and Recommended Performance Guidelines for Polymer Modified Micro-Surfacing 2003. One example of the particle size range in a typical conventional fine aggregate used in conventional sealing and microsurfacing slurries is set out as follows:

| Sieve Size | Total Percent Passing |
|---|---|
| ⅜ inch (9.5 mm) | 100 |
| No. 4 (4.75 mm) | 90 to 100 |
| No. 8 (2.36 mm) | 65 to 100 |
| No. 16 (1.18 mm) | 40 to 85 |
| No. 30 (600 μm) | 20 to 60 |
| No. 50 (300 μm) | 7 to 40 |
| No. 100 (150 μm) | 0 to 20 |
| No. 200 (75 μm) | 0 to 10 |

When crushing and grading aggregate for conventional asphalt mixes for use in road construction and repair, a considerable amount of aggregate, commonly called crusher dust, is screened out of the aggregate in order to bring the particle size range within the varied specified ranges for any particular application. There are therefore large stock piles of this reject aggregate material that have little utility. It has been found that some of this fine crushed aggregate that has been rejected for use in conventional asphalt mixes can provide satisfactory performance when used in the patching slurry of the present invention similar to the performance obtained when using aggregate meeting the conventional specifications above. Testing such reject aggregate will generally reveal at least some material that is satisfactory for the present use.

An example of a satisfactory patching slurry for use at an ambient temperature of 20° C. has the following composition:

100 grams conventional fine aggregate 11 grams water 14 grams Cationic Quick Set asphalt emulsion containing polymer 1.5 grams Normal Portland cement 0.2 grams set retarding agent The required set retarding agents are well known in the industry, although the chemical compositions used can vary, and are often maintained as trade secrets by suppliers. Adjustments in ingredient amounts could be required for different aggregates, temperatures, and like conditions.

The slurry is mixed for two to three minutes, and the slurry in this particular example has a break time of 19.5 minutes from the time the asphalt emulsion is added to the other ingredients. The asphalt emulsion is typically the last ingredient added to the mixer. Where the ambient temperature at the patching location is higher than 20° C., the amount of set retarder or water, or both will be increased slightly, and where the temperature is lower, these amounts will be reduced slightly. It is contemplated that other formulations could provide a satisfactory patching slurry as well.

To efficiently use patching slurry of the present invention, a mixing apparatus must be provided that can be conveniently mounted on a trailer, truck, or like mixing vehicle for movement to various patching sites, and for movement along the stretch of road being repaired ahead of the spreader vehicle so that when the hopper on the spreader vehicle is emptied, a fresh batch is quickly available to reload the hopper. Conventional batch mixing equipment such as that used to provide sealing slurries makes quite large batches that can be spread over a long period of time. A suitable apparatus for the method of the present invention must be able to make small batches that will fit into the hopper of the spreading vehicle so that the whole batch can be quickly spread. Once the asphalt emulsion is added, the patching slurry begins to break, and so the whole batch must be spread within about 20 minutes. As well, in order to provide a patching slurry with the desired break time and hardening time, the ingredients must be measured accurately, since small variations can significantly affect these times.

FIG. 1 illustrates an apparatus 20 adapted for mounting on a mixing vehicle, illustrated as a trailer 22, for mixing a patching slurry for repairing a road surface by filling depressed areas of the road surface with the patching slurry. The apparatus 20 comprises a mixing bowl 24 mounted at the rear end of the trailer 22. The trailer 22 can thus be towed by a truck 26 along the road ahead of the spreading vehicle 4, as illustrated in FIG. 2, and when the box 6 is empty, the trailer 22 is located in proximity to the spreader vehicle 4 to add a new batch of patching slurry to the hopper 2.

An aggregate measuring tank 30 is operatively connected to an aggregate holding tank 32 to receive aggregate therefrom. The aggregate measuring tank 30 is mounted on a scale 34 above the mixing bowl 24, and is operatively connected to the aggregate holding tank 32 by a belt conveyor 36 having an intake end located under a bottom discharge opening of the aggregate holding tank 32 and an output end located above the aggregate measuring tank 30. The scale 34 is operatively connected to the drive of the conveyor 36 and is operative to stop the conveyor 36 when a desired weight of aggregate is present in the aggregate measuring tank 30. The scale 34 is further operative to open a gate 38 on the bottom of the aggregate measuring tank 30 when the desired weight of aggregate is present in the aggregate measuring tank 30 such that the contents falls into the mixing bowl 24.

A control panel 39 houses a switch operative to transfer aggregate from the aggregate holding tank 32 to the aggregate measuring tank 30 by starting the conveyor 36. Once started the conveyor 36 will run until the scale 34 senses that the desired weight of aggregate is present in the aggregate measuring tank 30, at which time the conveyor 36 will stop, and the gate 38 will open and the measured amount of aggregate will drop into the mixing bowl 24. Thus the operator only has to flip the switch and then the apparatus is operative to deposit the measured amount of aggregate into the mixing bowl 24.

Figure 3:
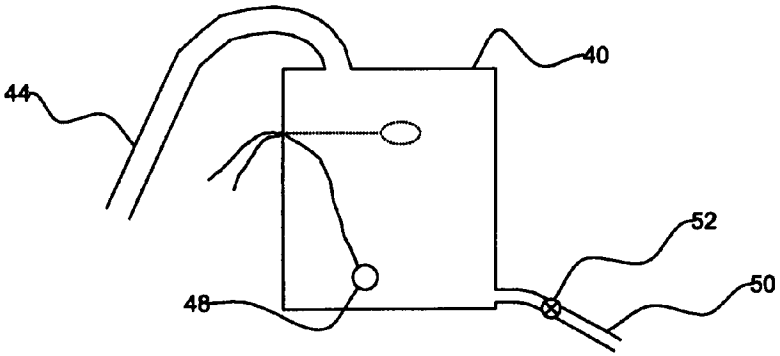
FIG. 3 is a schematic side view of the asphalt emulsion measuring tank.

An asphalt emulsion measuring tank 40 is operatively connected to an asphalt emulsion holding tank 42 to receive asphalt emulsion therefrom. The operative connection is by a conduit 44 and pump 46. As illustrated in FIG. 3, a float 48 is located in the asphalt emulsion measuring tank 40. The float 48 moves up and down with the liquid level in the asphalt emulsion measuring tank 40, and is operatively connected to the pump 46 such that the pump 46 stops when the float 48, and the liquid asphalt emulsion level reaches a desired level. The float 48 is adjusted such that the level of asphalt emulsion corresponds to the amount desired for a batch of patching slurry. The contents of the asphalt emulsion measuring tank 40 is transferred into the mixing bowl 24 through a conduit 50 connected to a bottom of the asphalt emulsion measuring tank 40. A valve 52 in the conduit 50 is operative to selectively release the contents of the asphalt emulsion measuring tank 40 through a discharge end of the conduit 50 into the mixing bowl 24. The valve 52 is conveniently an electric solenoid valve controlled from a switch in the control panel 39.

Thus the operator starts the pump 46 with a switch on the control panel, and the asphalt emulsion is pumped into the asphalt emulsion measuring tank 40 until the desired level is sensed by the float 48, and the pump 46 stops. The desired amount of asphalt emulsion is thus measured out and available. When the operator desires to add the asphalt emulsion to the mixing bowl 24, he simply flips another switch on the control panel 39 to open the valve 52, and drain the contents of the asphalt emulsion measuring tank 40 into the mixing bowl.

A water measuring tank 60 is operatively connected to a water holding tank 62 to receive water therefrom. In the illustrated embodiment the water tanks 60, 62 are connected, filled, and drained in the same manner as described above for the asphalt emulsion tanks 40,42.

It is contemplated that many other well known transferring, metering, and weighing mechanisms could also be used to ensure the proper amounts of aggregate, asphalt emulsion, and water are deposited in the mixing bowl 24, the described means are conveniently controlled by the operator and allow for mixing repeated batches quickly and easily.

Means are provided to add a measured amount of a retarding agent to the mixing bowl 24, the retarding agent operative to increase a break time of the patching slurry. While separate holding and measuring tanks could be provided as with the asphalt emulsion and water, or other metering means could be used, in the illustrated embodiment the means to add a measured amount of a retarding agent to the mixing bowl 24 is provided by adding a desired proportion of retarding agent into water contained in the water holding tank 62. With the proper proportion of retarding agent to water in the water holding tank 62, the liquid level in the water measuring tank 60 at which the float shuts off the pump will be calculated to correspond to the required amount of both water and retarding agent to mix one batch of patching slurry.

Means are also provided to add a measured amount of Portland cement to the mixing bowl 24. A Portland cement holding tank 70 is provided, and a screw conveyor 72 having an intake end oriented to receive Portland cement from the Portland cement holding tank 70 and an output end oriented to discharge Portland cement into the mixing bowl 24. The screw conveyor 72 is calibrated and controlled to rotate for a time sufficient to transfer the desired amount of Portland cement from the Portland cement holding tank 70 into the mixing bowl 24. It is contemplated that the output end of the screw conveyor 72 could also be oriented to discharge Portland cement onto the aggregate being carried by the belt conveyor 36. The screw conveyor 72 and aggregate conveyor 36 would run at the same time, and the Portland cement could thus be better distributed though the aggregate and the patching slurry.

Alternatively, since the amount of Portland cement required in each batch is small, conveniently and economically a scoop 74 could be calibrated so that the operator can scoop the measured amount of Portland cement out of the Portland cement holding tank 70 and place same into the mixing bowl 24.

Figure 4:
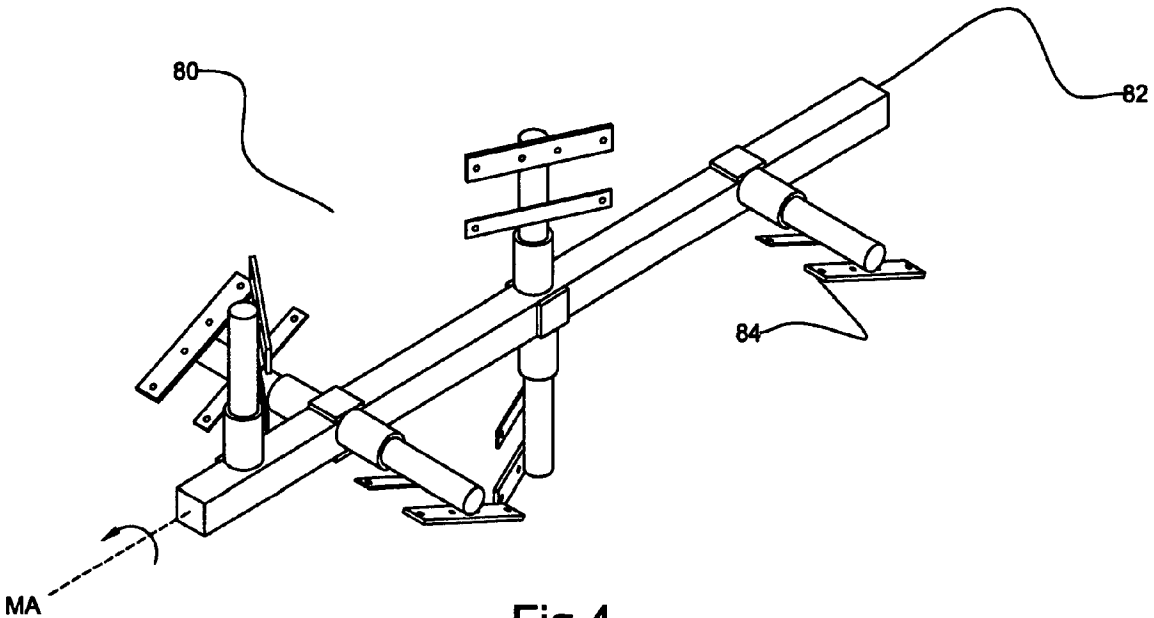
FIG. 4 is a perspective view of the mixer in the mixing bowl.

A mixer 80 is operative to mix aggregate, Portland cement, asphalt emulsion, water, and retarding agent contained in the mixing bowl 24 into a patching slurry. FIG. 4 illustrates an embodiment of a suitable mixer 80 that is similar to a conventional mortar mixer. The illustrated mixer 80 comprises a mixer shaft 82 extending through the mixing bowl 24 as seen in FIG. 1, and a plurality of paddles 84 attached to the mixer shaft 82 as illustrated. A drive motor is operative to rotate the mixer shaft 82 about its axis MA.

In the illustrated embodiment and as seen in FIG. 1, means to transfer the patching slurry out of the mixing bowl 24 is provided by pivotally mounting the mixing bowl 24 about a pivot axis PA such that the mixing bowl 24 can be selectively moved from an upright mixing position shown in FIG. 1, wherein contents of the mixing bowl 24 are retained in the mixing bowl 24, to a tilted dumping position wherein contents of the mixing bowl 24 pour out of the mixing bowl 24. An actuator 88 is provided to move the mixing bowl about the pivot axis PA. Alternatively a gate and chute could be provided on the bottom of the mixing bowl 24, or other mechanisms known in the art could be used to transfer the patching slurry out of the mixing bowl 24 and into the hopper 2.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An apparatus adapted for mounting on a mixing vehicle for mixing a patching slurry for repairing a road surface by filling depressed areas of the road surface with the patching slurry, the apparatus comprising:

a mixing bowl;

an aggregate holding tank, and an aggregate measuring tank operatively connected to the aggregate holding tank to receive aggregate therefrom, and means for transferring the contents of the aggregate measuring tank into the mixing bowl;

an asphalt emulsion holding tank, and an asphalt emulsion measuring tank operatively connected to the asphalt emulsion holding tank to receive asphalt emulsion therefrom, and means for transferring the contents of the asphalt emulsion measuring tank into the mixing bowl;

a water holding tank, and a water measuring tank operatively connected to the water holding tank to receive water therefrom, and means for transferring the contents of the water measuring tank into the mixing bowl;

means for adding a measured amount of Portland cement to the mixing bowl;

means for adding a measured amount of a retarding agent to the mixing bowl, the retarding agent operative to increase a break time of the patching slurry, a mixer operative to mix aggregate, Portland cement, asphalt emulsion, water, and retarding agent contained in the mixing bowl into a patching slurry having a temperature substantially equal to ambient temperature;

wherein the mixing bowl is pivotally mounted such that the mixing bowl can be selectively moved from an upright mixing position, wherein contents of the mixing bowl are retained in the mixing bowl, to a tilted dumping position wherein contents of the mixing bowl pour out of the mixing bowl.

2. The apparatus of claim 1 wherein the means for adding a measured amount of a retarding agent to the mixing bowl is provided by adding a desired proportion of retarding agent into water contained in the water holding tank.

3. The apparatus of claim 1 wherein the aggregate measuring tank is mounted on a scale above the mixing bowl, and the aggregate measuring tank is operatively connected to the aggregate holding tank by a conveyor having an intake end located under a bottom discharge opening of the aggregate holding tank and an output end located above the aggregate measuring tank.

4. The apparatus of claim 3 wherein the scale is operatively connected to a conveyor drive and is operative to stop the conveyor when a desired weight of aggregate is present in the aggregate measuring tank.

5. The apparatus of claim 4 wherein the means for transferring the contents of the aggregate measuring tank into the mixing bowl comprises a gate on a bottom of the aggregate measuring tank.

6. The apparatus of claim 1 wherein the means for adding a measured amount of Portland cement to the mixing bowl comprises a Portland cement holding tank, and a scoop calibrated such that an operator can scoop the measured amount of Portland cement out of the Portland cement holding tank and place same into the mixing bowl.

7. The apparatus of claim 1 wherein the means for adding a measured amount of Portland cement to the mixing bowl comprises a Portland cement holding tank and a screw conveyor having an intake end oriented to receive Portland cement from the Portland cement holding tank and an output end oriented to discharge Portland cement into the mixing bowl, and wherein the screw conveyor is calibrated and controlled to rotate for a sufficient time to transfer the measured amount of Portland cement from the Portland cement holding tank into the mixing bowl.

8. The apparatus of claim 1 wherein the mixer comprises a mixer shaft extending through the mixing bowl, a plurality of paddles attached to the mixer shaft, and a drive motor operative to rotate the mixer shaft.

9. The apparatus of claim 1 further comprising a control panel comprising a control operative to transfer aggregate from the aggregate holding tank, to the aggregate measuring tank.

10. The apparatus of claim 9 wherein the control panel further comprises a control operative to transfer asphalt emulsion from the asphalt emulsion holding tank to the asphalt emulsion measuring tank, and a control operative to transfer the contents of the asphalt emulsion measuring tank into the mixing bowl.

11. An apparatus adapted for mounting on a mixing vehicle for mixing a patching slurry for repairing a road surface by filling depressed areas of the road surface with the patching slurry, the apparatus comprising:

a mixing bowl;

an aggregate holding tank, and an aggregate measuring tank operatively connected to the aggregate holding tank to receive aggregate therefrom, and means for transferring the contents of the aggregate measuring tank into the mixing bowl;

an asphalt emulsion holding tank, and an asphalt emulsion measuring tank operatively connected to the asphalt emulsion holding tank to receive asphalt emulsion therefrom, and means for transferring the contents of the asphalt emulsion measuring tank into the mixing bowl;

a water holding tank, and a water measuring tank operatively connected to the water holding tank to receive water therefrom, and means for transferring the contents of the water measuring tank into the mixing bowl;

means for adding a measured amount of Portland cement to the mixing bowl;

means for adding a measured amount of a retarding agent to the mixing bowl, the retarding agent operative to increase a break time of the patching slurry a mixer operative to mix aggregate, Portland cement, asphalt emulsion, water, and retarding agent contained in the mixing bowl into a patching slurry having a temperature substantially equal to ambient temperature;

means for transferring the patching slurry out of the mixing bowl into a spreading vehicle;

wherein at least one of the asphalt emulsion measuring tank and the water measuring tank is operatively connected to a corresponding holding tank by a conduit and pump, and wherein the pump stops when a desired amount is present in the at least one measuring tank; and comprising a float located in the at least one measuring tank, and wherein the float is operatively connected to the pump such that the pump stops when the float reaches a desired level.

12. The apparatus of claim 11 wherein the means for transferring the contents of the at least one measuring tank into the mixing bowl comprises a conduit connected to a bottom of the at least one measuring tank, and a valve in the conduit operative to selectively release the contents of the at least one measuring tank through a discharge end of the conduit into the mixing bowl.

13. The apparatus of claim 10 wherein the control panel further comprises a control operative to transfer water from the water holding tank to the water measuring tank, and a control operative to transfer the contents of the water measuring tank into the mixing bowl.

14. A method of repairing a road surface by filling depressed areas of the road surface with a patching slurry, the method comprising:

with the apparatus of claim 1, mixing a batch of patching slurry comprising ingredients including aggregate, asphalt emulsion, water, portland cement, and a retarding agent, and adjusting the ingredients to provide a patching slurry having a break time sufficiently long to allow the batch to be spread before the patching slurry begins to set, and sufficiently short to allow traffic to pass over a filled depressed area within a desired time;

providing a spreading vehicle comprising a slurry hopper and an agitator in the slurry hopper; a spreading box mounted under the slurry hopper such that bottom edges of the spreading box can be placed on the road surface; a gate operative to selectively release patching slurry from the slurry hopper into the spreading box; and an actuator operative to move the spreading box up and down relative to the vehicle;

maneuvering the slurry hopper to receive the batch of patching slurry transferred out of the mixing bowl, and depositing the batch of patching slurry into the hopper;

successively maneuvering the spreading vehicle to spread the batch of patching slurry.

15. An apparatus adapted for mounting on a mixing vehicle for mixing a patching slurry for repairing a road surface by filling depressed areas of the road surface with the patching slurry, the apparatus comprising a mixing bowl;

an aggregate holding tank, and an aggregate measuring tank mounted on a scale above the mixing bowl;

a gate on a bottom of the aggregate measuring tank above the mixing bowl;

a conveyor having an intake end located under a bottom discharge opening of the aggregate holding tank and an output end located above the aggregate measuring tank;

wherein the scale is operatively connected to a conveyor drive and is operative to stop the conveyor when a desired weight of aggregate is present in the aggregate measuring tank; pg,31 an asphalt emulsion holding tank, and an asphalt emulsion measuring tank operatively connected to the asphalt emulsion holding tank to receive asphalt emulsion therefrom, and. means for transferring the contents of the asphalt emulsion measuring tank into the mixing bowl;

a water holding tank, and a water measuring tank operatively connected to the water holding tank to receive water therefrom, and means for transferring the contents of the water measuring tank into the mixing bowl;

means for adding a measured amount of Portland cement to the mixing bowl;

means for adding a measured amount of a retarding agent to the mixing bowl, the retarding agent operative to increase a break time of the patching slurry;

a mixer operative to mix aggregate, portland cement, asphalt emulsion, water, and retarding agent contained in the mixing bowl into a patching slurry having a temperature substantially equal to ambient temperature;

means for transferring the patching slurry out of the mixing bowl into a spreading vehicle.

* * * * *